United States Patent [19]

Townsend

[11] 4,023,536

[45] May 17, 1977

[54] METHOD OF CONTROLLING THE TIMING OF IGNITION IN AN INTERNAL COMBUSTION ENGINE

[75] Inventor: Ray T. Townsend, Des Moines, Iowa

[73] Assignee: Townsend Engineering Company, Des Moines, Iowa

[22] Filed: Jan. 2, 1975

[21] Appl. No.: 538,106

Related U.S. Application Data

[63] Continuation of Ser. No. 286,189, Sept. 5, 1972, abandoned.

[52] U.S. Cl. ..... 123/26; 123/119 CE; 123/75 D; 123/119 DB; 123/32 R; 123/44 E

[51] Int. Cl.[2] ..... F02B 3/00; F02M 7/00; F02B 41/00

[58] Field of Search ..... 123/26, 75 D, 119 CE, 123/119 D, 119 DB, 124 R, 32 R

[56] References Cited

UNITED STATES PATENTS

| | | | |
|---|---|---|---|
| 1,653,877 | 12/1927 | Schaff | 123/75 |
| 2,196,071 | 4/1940 | Hudson | 123/26 |
| 2,670,724 | 3/1954 | Reggio | 123/119 CE |
| 3,650,261 | 3/1972 | Hutsell | 123/26 |

*Primary Examiner*—Ronald B. Cox
*Attorney, Agent, or Firm*—Zarley, McKee, Thomte & Voorhees

[57] ABSTRACT

A method of controlling the timing of ignition in an internal combustion engine comprising cylinders and reciprocating pistons and having a supply of fuel and air to the cylinders by determining the conditions of temperature and/or pressure within at least one of the cylinders when the engine is operating under the desired conditions, said determination being made at a position of the piston when the conditions of temperature and/or pressure are less than maximum, and when the engine is loaded rather than idling. These measured conditions are then monitored to detect any variations in temperature and/or pressure, and the desired conditions of temperature and/or pressure are then restored to the cylinder whenever variations therein are detected by adjusting the amount of air supplied to the cylinder.

15 Claims, 20 Drawing Figures

22
20
208
210
230
228
226
14
90
18
19.
238
212
196
213
224
72
218
222
234
204
206
170
216
232
192
214
242
190
86
118
236
26
30
126
240
138
136
134
122
19.
17.
46
17.
208
202
206
86
210
238
208
200
211
90"
211
220
204
244
234
210
236
236
236
246
242
240
246
60
104
18
236
242
240

220
208
210
213
212
214
224
238
228
211
218
216
206
204
222
240
230
226
211
18.
18.

208A
250
248
206
232
234
204
236
240
242

METHOD OF CONTROLLING THE TIMING OF IGNITION IN AN INTERNAL COMBUSTION ENGINE

This application is a continuation of application Ser. No. 286,189 filed Sept. 5, 1972, now abandoned. In diesel engines, fuel oil or the like is sprayed or injected into the cylinder after the air therein has been compressed to about 1000° F., thus causing the ignition of the oil. Since the compression in a diesel is controlled by a crank instead of a cam, the exact point at which the fuel mixture attains firing temperature will vary considerably so that accurate timing cannot be maintained. This same problem exits in all such compression-type engines. Variations in temperature and atmospheric pressure cause corresponding variations in ignition timing. While attempts have been made to monitor pressures and temperatures within engine cylinders, these efforts have neither endeavored to nor achieved improvements in controlling ignition timing. One of the reasons that these prior methods have not been useful in controlling variations in ignition timing is that only optimum conditions of pressure or temperature are used to trigger a supply of compensating air or fuel to the cylinder. A further shortcoming of existing methods is that the monitoring of cylinder conditions is substantially continuous throughout the engine cycle rather than at a specific point in the cycle.

Therefore, it is a principal object of this invention to provide an improved method of timing the ignition of an internal combustion engine.

A further object of this invention is to provide an internal combustion engine with pressure or temperature sensing means associated with the cylinders so that the timing of ignition of fuel within the cylinders can be carefully monitored and controlled.

A further object of this invention is to provide a method of timing the ignition of an internal combustion engine by determining variations in temperature or pressure at a given point or increment in the engine cycle, preferably at levels less than maximum, and then restoring the original conditions of temperature and pressure to the cylinder by controlling the air flow thereto.

These and other objects will be apparent to those skilled in the art.

This invention consists in the various steps of the method, whereby the objects contemplated are attained as hereinafter more fully set forth, specifically pointed out in the claims, and illustrated in the accompanying drawings, in which:

A description of the method of this invention requires a description of at least the principal components of an internal combustion engine upon which the method can be practiced.

The structure particularly relevant to the method as shown in FIGS. 16–20.

Figure 1:
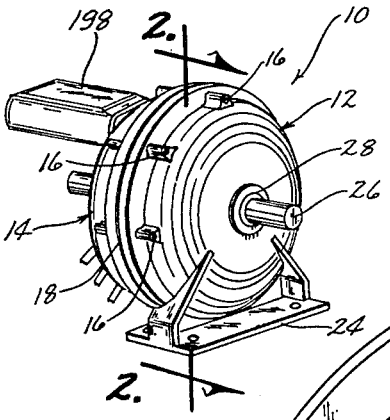
FIG. 1 is a perspective view of an engine capable of using the method of this invention.
Figure 2:
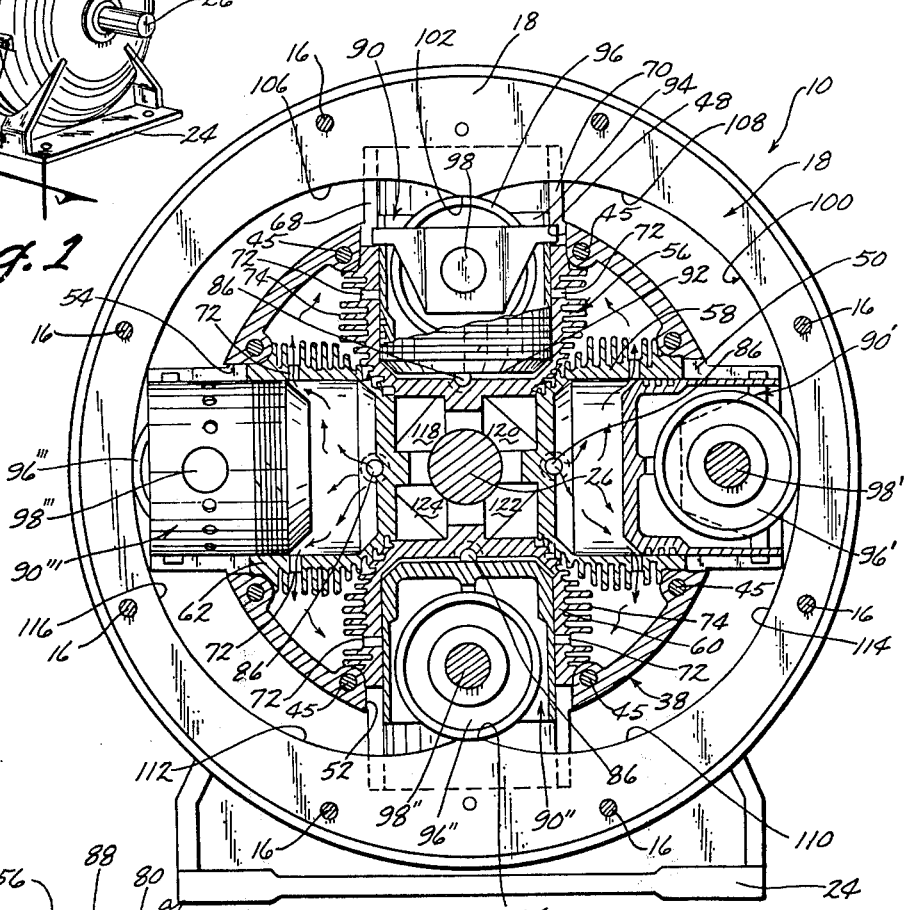
FIG. 2 is an enlarged sectional view seen along lines 2—2 of FIG. 1 with portions thereof cut away to more fully illustrate the invention.

The engine 10 is generally comprised of engine frames 12 and 14 secured together by bolts 16 or other suitable means as seen in FIGS. 1 and 2. As shown in FIG. 1, a circular cam plate 18 is positioned between the frames 12 and 14 with the bolts 16 extending therethrough. Cam plate 18 is positioned with respect to the peripheral edges of frames 12 and 14 by the annular recesses 20 and 22 formed therein respectively. Frame 12 includes a bracket portion 24 extending therefrom for mounting the engine.

Drive or rotor shaft 26 rotatably extends through the frames 12 and 14 and is supported therein by main bearings 28 and 30 positioned in frames 12 and 14 respectively. Rotor 32 is mounted on the shaft 26 for rotation therewith and comprises a hub portion 34 and spokes 36 which extend radially outwardly therefrom to a rim portion 38. Hub portion 34 is secured to shaft 32 by such means as a screw or the like extending through opening 40. Rim portion 38 is comprised of rim members 41 and 43 held together by bolts 45.

Spacer 42 embraces shaft 26 between the outer end of hub portion 34 and the inner end of bearing 28. It can be seen in FIG. 12 that shaft 26 is provided with shoulders 44 and 46 which engage the inner ends of bearings 28 and 30 respectively to aid in positioning shaft 26 with respect to the engine frames.

Figure 3:
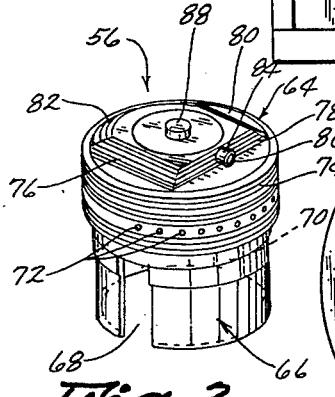
FIG. 3 is a perspective view of one of the cylinders of the engine.
Figure 4:
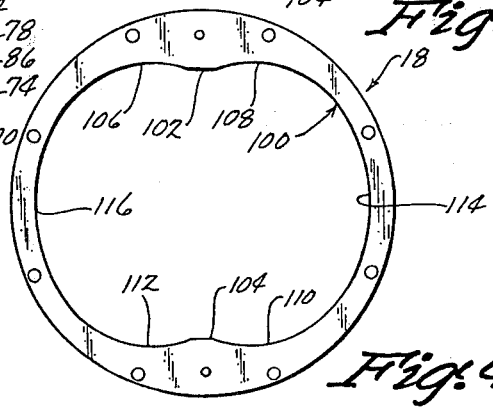
FIG. 4 is a plan view of the cam plate employed in the engine.

Rotor 32 is provided with circular openings 48, 50, 52 and 54 formed in its rim portion 38 which have cylinders 56, 58, 60 and 62 mounted therein respectively. Inasmuch as all of the cylinders are identical, only cylinder 56 will be described in detail. Cylinder 56 generally comprises a head portion 64 and a skirt portion 66. Skirt portion 66 is provided with opposing slots 68 and 70 formed therein and a plurality of exhaust openings 72 which extend through the cylinder for a portion of its circumference. Cylinder 56 is also provided with cooling fins 74 as illustrated in FIG. 3. As shown in FIG. 3, head portion 64 includes shoulders 76, 78, 80 and 82. Cylinder 56 has a ferrule projection 84 which extends horizontally therefrom through which extends the intake port 86. Intake port 86 communicates with the interior of the cylinder. Cylinder 56 also has a projection 88 extending from its inner end.

Piston 90 is slidably mounted in cylinder 56 and generally comprises a head portion 92 and a skirt portion 94. A roller 96 is mounted on shaft 98 which is secured to the skirt portion 94. Roller 96 rolls upon the cam surface 100 of cam plate 18 to cause the piston to move with respect to the cylinder as the rotor or core of the engine rotates. Preferably, cam surface 100 includes oppositely disposed lobes 102 and 104 which are slightly flattened to provide a "dwell" area as will be explained in more detail hereinafter. The "dwell area" may be omitted if desired but the preferred embodiment includes such "dwell areas." For purposes of description, the cam surfaces closely adjacent the opposite sides of lobe 102 will be indicated by the reference numerals 106 and 108 respectively while the cam surfaces closely adjacent the opposite sides of lobe 104 will be indicated by the reference numerals 110 and 112 respectively. The cam surface approximately midway between 108 and 110 will be referred to by the reference numeral 114 while the reference numeral 116 will refer to the cam surface approximately midway between 106 and 112.

Four plates 118, 120, 122 and 124 (generally triangular in shape) are positioned between the cylinders and the shaft 26 at one side of the projections 88 while plates 126, 128 (not shown), 130 and 132 (not shown) are positioned between the cylinders and shaft 26 at the other side of the projections 88. The plates 126, 128, 130 and 132 are also generally triangular in shape. The plates may be held in place by any suitable means such as screws or the like extending therethrough which engage the shaft 26.

Ferrules or pins 134 are secured to the plates 118, 120, 122 and 124 and extend therefrom in a parallel relationship to shaft 26. Springs 136 embrace the pins 134 with the inner ends thereof engaging the plates associated therewith.

Figure 5:
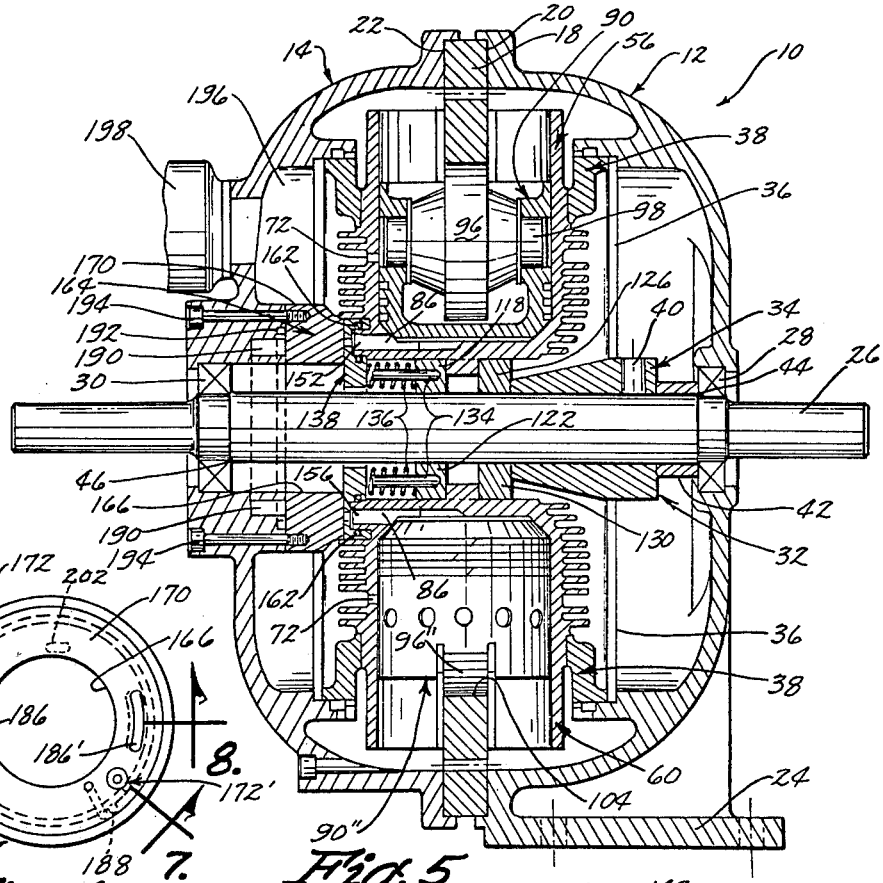
FIG. 5 is a sectional view of the engine as would be seen along lines transverse to the sectional view of FIG. 2.
Figure 9:
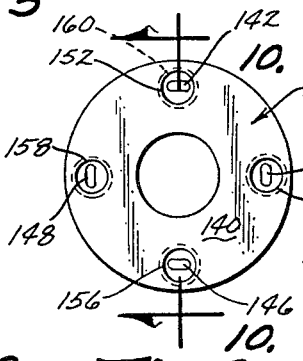
FIG. 9 is an elevational view of the seal plate.
Figure 10:
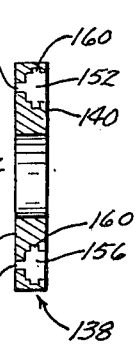
FIG. 10 is a sectional view seen along lines 10—10 of FIG. 9.
Figure 11:
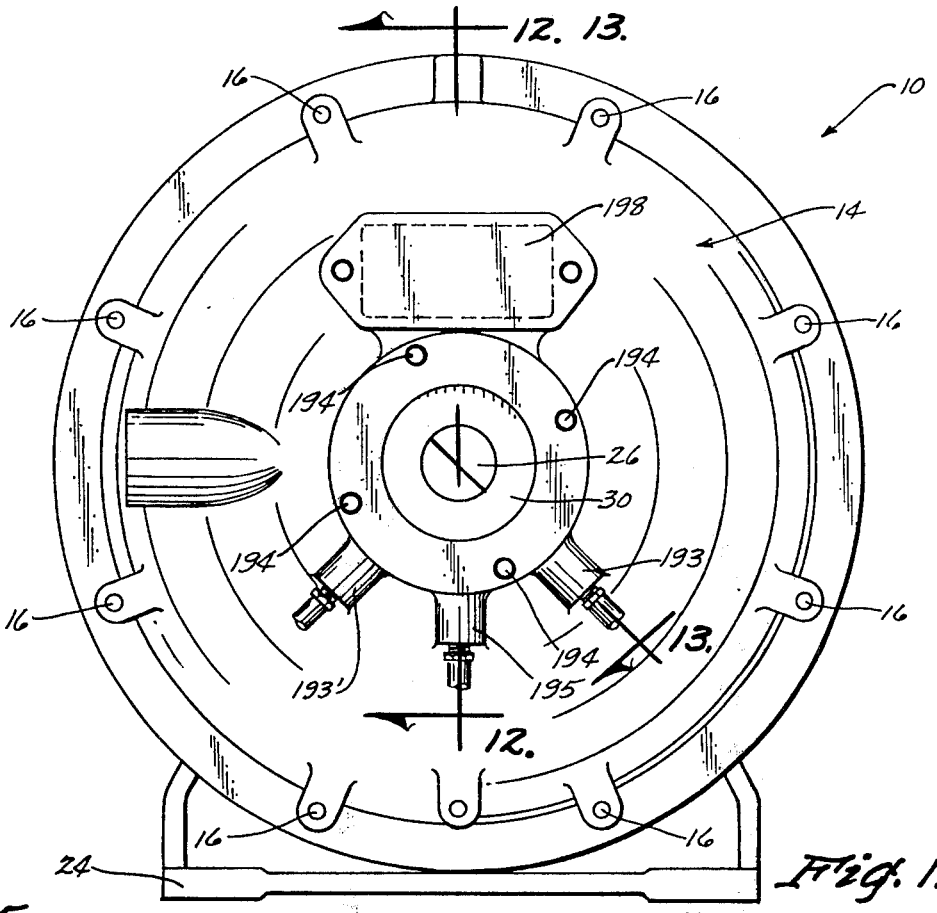
FIG. 11 is an end view of the engine.
Figure 14:
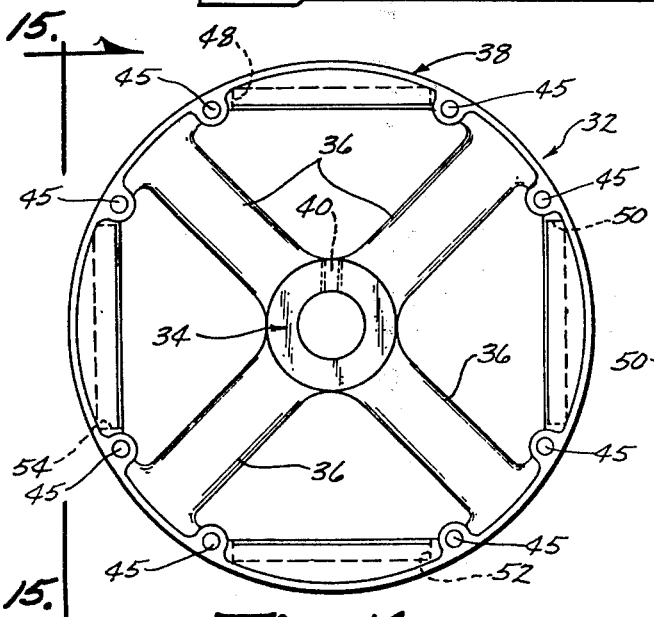
FIG. 14 is an end view of the rotor of the engine.
Figure 15:
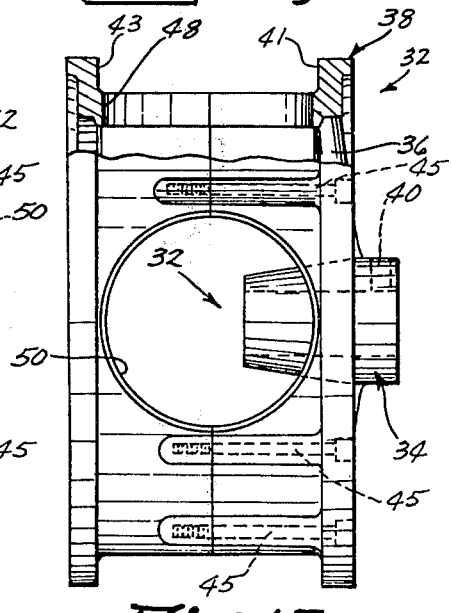
FIG. 15 is a partial top view of the rotor of FIG. 14.

Seal plate 138 is mounted on shaft 26 for rotation therewith as seen in FIG. 5 with its inner surface 140 being engaged by the springs 136. Seal plate 138 has slots 142, 144, 146 and 158 formed therein extending inwardly from outer surface 150. FIG. 9 illustrates the fact that the longitudinal axis of slots 142, 144, 146 and 148 are disposed transversely with respect to radial axes extending therethrough and that the slots are 90° apart. Circular openings 152, 154, 156 and 158 extend inwardly into surface 140 of seal plate 138 and communicate with the slots 142, 144, 146 and 148 respectively. An annular channel 160 is formed in the seal plate 138 around each of the openings 152, 154, 156 and 158 for receiving an O-ring 162 therein. The openings 152, 154, 156 and 158 each receive one end of the ferrule projections (such as 84) therein so that the intake port in the ferrule projection communicates with the slots (such as 142). The O-ring 162 embraces the ferrule projections to seal the same. The seal plate 138 is rotated with the rotor due to the ferrule projections of the cylinders being received in the circular openings in the seal plate.

Figure 7:
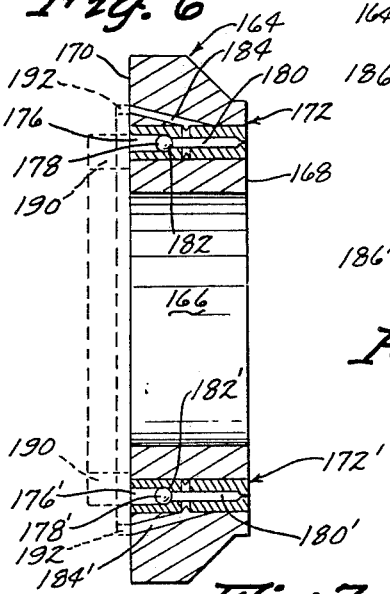
FIG. 7 is an enlarged sectional view seen along lines 7—7 of FIG. 6.

The numeral 164 refers to a valve plate having a central opening 66 and inner and outer surfaces 168 and 170 respectively. A pair of valve inserts 172 and 172′ are mounted in the valve plate 164 in an oppositely disposed relationship. Inasmuch as valve inserts 172 and 172′are identical, only valve insert 172 will be described in detail with " ′ " indicating identical structure on valve insert 172′. Valve insert 172 has a bore 176 formed therein which extends inwardly thereinto from the outer surface thereof and which has a ball valve 178 received therein. Bore 180 communicates with bore 176 and extends outwardly through the inner surface of the valve plate 164. As seen in FIG. 7, bore 180 has a smaller diameter than bore 176 to define a valve seat 182 therebetween upon which ball valve 178 may seat to prevent communication from bore 176 to bore 180. As also seen in FIG. 7, the inner end of bore 180 has a reduced diameter. Bore 184 extends inwardly from surface 170 and communicates with bore 180 inwardly of valve seat 182.

Figure 6:
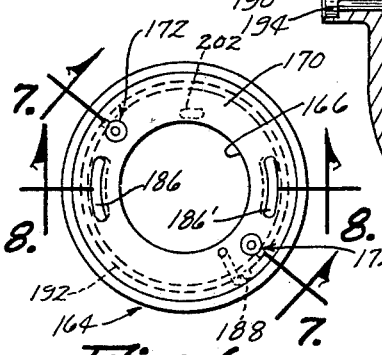
FIG. 6 is an elevational view of the valve plate.
Figure 8:
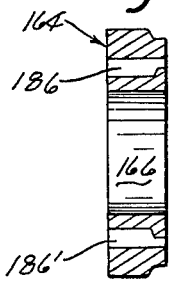
FIG. 8 is an enlarged sectional view seen along lines 8—8 of FIG. 6.

A pair of air inlet openings 186 and 186′ extend through the valve plate 164 as illustrated in FIGS. 6 and 8 in an oppositely disposed relationship.

The openings 186 and 186′ are arcuate slots and have inner ends with smaller cross-sectional area (FIG. 8). The inner surface of valve plate 164 is provided with an oil channel means 188 extending through the valve plate to lubricate the inner surface of valve plate 164 and the outer surface of seal plate 138. The oil channel means 188 is in communication with a source of lubricating oil.

Frame 14 of the engine is provided with an annular channel or groove 190 which is in communication with the air source. Frame 14 is also provided with an annular channel or groove 192 which is in communication with the fuel source. Channels 190 and 192 are sealed from each other. Fuel inlets 193 and 193′ are provided on the frame 14 and are in communication with the channel 192 and in communication with the bores 184 and 184′ in valve plate 164. The engine frame 14 is also provided with an air inlet 195 which is in communication with the channel 190.

Bolts 194 maintain valve plate 164 in position as illustrated in FIG. 5. An annular exhaust chamber 196 is provided in the engine frame 14 for communication with the ports 72 of the cylinders for exhausting the exhaust from the engine through the exhaust manifold or muffler 198.

In operation, fuel under pressure is constantly supplied to bores 184 and 184′ through the channel 192 and fuel inlets 193 and 193′. The only time that fuel will pass through the inner ends of bores 180 and 180′ is when the bores 180 and 180′ communicate with certain of the openings 142, 144, 146 and 148. When the bores 180 and 180′ communicate with openings 142, 144, 146 or 148, fuel will be sprayed into the interior of the cylinders through the inlet port 86. Air under pressure is constantly supplied to openings 186 and 186′ through the channel 190 and air inlet 195. The only time that air will be supplied to the interior of the cylinders is when the openings 186 and 186′ communicate with openings 142, 144, 146 or 148. Thus, as the rotor rotates, the seal plate 138 is rotated with and by the cylinders so that the openings 142, 144, 146 and 148 successively pass the opening 186, bore 180, opening 186′ and bore 180′.

The movement of the pistons, with respect to the cylinders, is controlled by the rollers thereon rolling upon the cam surface 100. The pistons are "free floating" and are urged outwardly into engagement with the cam surface by centrifugal force, combustion forces and air pressure exerted against the head of the piston at certain times.

Figure 12:
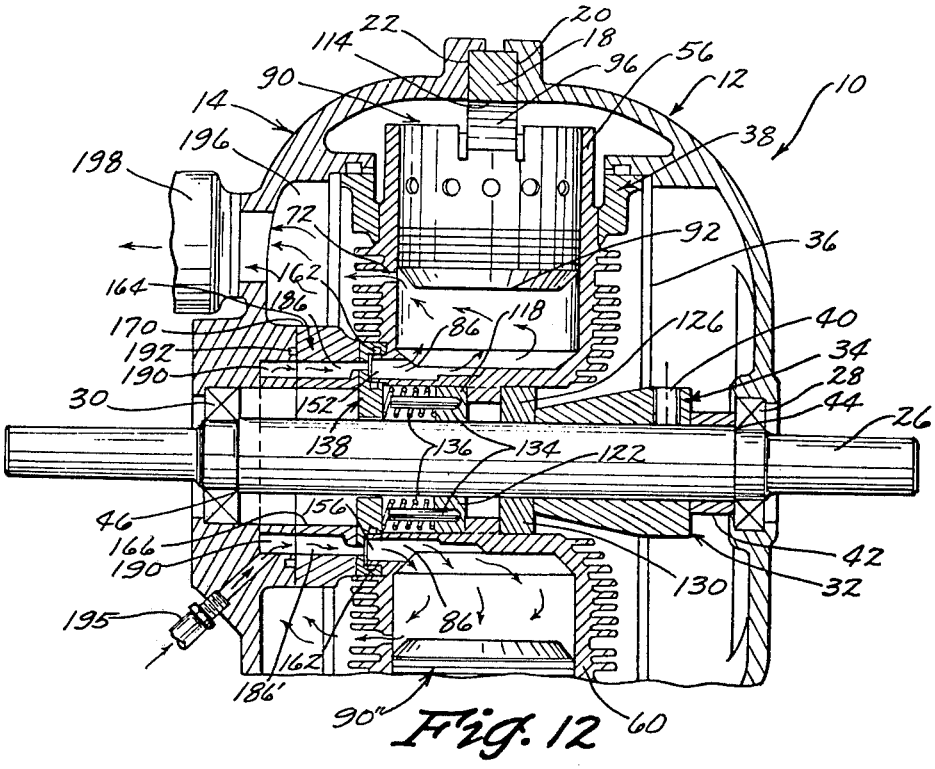
FIG. 12 is a partial sectional view seen along lines 12—12 of FIG. 11.
Figure 13:
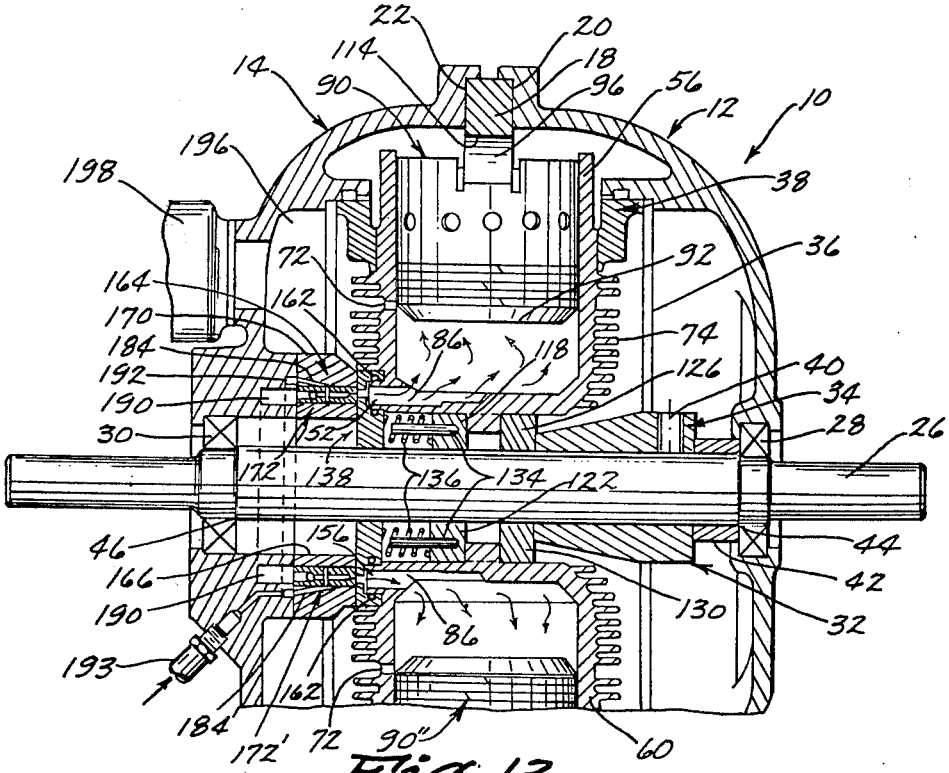
FIG. 13 is a partial sectional view seen along lines 13—13 of FIG. 11.

FIG. 5 illustrates the top and bottom pistons in firing positions. In the position of FIG. 5, the rollers on the pistons are on the "dwell" areas of the lobes 102 and 104 respectively. Inasmuch as the operation of the top piston is identical to the operation of the bottom piston (FIG. 5), only the operation or cycles of the top piston will be described. The combustion of the fuel-air mixture in cylinder 56 will cause the piston 90 to begin to "expand" or move outwardly with respect to the cylinder so that the roller moves from the lobe 102 onto the cam surface indicated by 108 with the expansion of the piston causing the rotor 32 and shaft 26 to be rotated. The curvature or sweep of the cam surface at 108 is such that the piston is allowed to expand at a comparatively rapid rate after explosion or burning has progressed adequately. This rapid expansion (compared to the crank engine) converts the heat to mechanical energy in a very short time rather than allowing it to be conducted into the cylinder walls, etc. In other words, considerably more of the heat of the explosion is converted to mechanical energy rather than becoming a cooling problem to the structure of the engine. The piston continues to expand due to the combustion forces on the head thereof until the head of the piston has moved past the ports 72 in the cylinder to permit the exhaust gases to be exhausted outwardly therethrough. As the ports 72 are opened, one of the openings 142, 144, 146 or 148 has been rotated into communication with opening 186 to permit air to be forced or pumped into the cylinder to drive or exhaust the exhaust gases from the interior of the cylinder by way of the ports 72 as illustrated in FIG. 12. The incoming air also serves to charge the cylinder for the next compression cycle. The fact that the cylinders are exhausted through ports around the cylinder substantially reduces serious heat problems ordinarily connected with conventional rotary engines. In the engine of this invention, the exhaust from each cylinder is exhausted through its individual exhaust ports rather than all of the cylinders concentrating their exhaust gases through the same exhaust port of the valving plate.

Continued rotation of the rotor causes the roller on the piston to approach 114 on the cam surface. As the roller moves past 114, the piston is moved inwardly into cylinder 56 thereby closing the ports 72 so that the air in the cylinder can be gradually compressed. After good exhaust and good intake air has occurred, the opening 142 has moved out of communication with opening 186 and moved into communication with bore 180 of fuel insert 172 so that fuel is sprayed into the cylinder to mix with the air that is just beginning to be compressed. In a diesel engine, the fuel cannot be injected until the point of firing so that is inadequate time for volatization and complete burning of the fuel. In a gasoline engine, the fuel is injected with the air so it has considerable time to volatize and mix with the air molecules. However, only a mixture in the neighborhood of 13 to 1 will ignite and propagate a flame from the spark plug. Even at the leanest practical fuel-air ratio in a gasoline engine, there is not enough oxygen to thoroughly consume all of the fuel products thereby resulting in pollution. In the engine previously described, the fuel is injected into the air early enough in the compression cycle so that complete volatization and mixing will occur as it is being compressed, so that once combustion temperature and pressure is attained, it is ready to burn almost instantly.

The piston is then moved through its compression cycle wherein the piston is suddenly compressed through the firing range. The sudden compression of the piston is achieved as the roller of the piston moves onto the area of the cam surface designated by the numeral 110. Preferably, at the point of maximum compression, a slight dwell is provided due to the dwell areas on the lobes, in order to give more time for the explosion or burning to occur. Under the conditions of the previously described engine, since the fuel has been injected before compression, the fuel has had adequate time to more fully volatize and therefore the explosion is much more rapid than a conventional diesel. As soon as the explosion or burning has progressed adequately, the piston is allowed to expand at a comparatively rapid rate since the roller thereon moves onto the cam surface designated by the reference numeral 112. The rapid expansion of the piston coverts the heat to mechanical energy as previously discussed. The air supplied to engine 10 may be provided by a separate compressor driven from the engine. Previously, rotary engines have been provided which attempted to utilize conventional vacuum type breathing but it has been found that the centrifugal force of the engine is not enough to be dependable for maintaining the pistons outwardly against the cam while still providing adequate suction to charge the cylinder with air. A constant displacement is provided in engine 10 which increases or decreases the volume of air fed into the cylinders as the speed of the engine increases or decreases. In other words, the proper volume of air is always fed into the cylinder regardless of the speed, because if the air does not have time to flow through the intake port as the speed of the engine increases, then the air pressure will build up to where it will flow through the port in the amount of time provided. This feature provides a means of insuring a complete cylinder full of air regardless of the engine's speed which is a definite advantage over most conventional crank engines.

Figures 16, 17, 18, 19, 20:
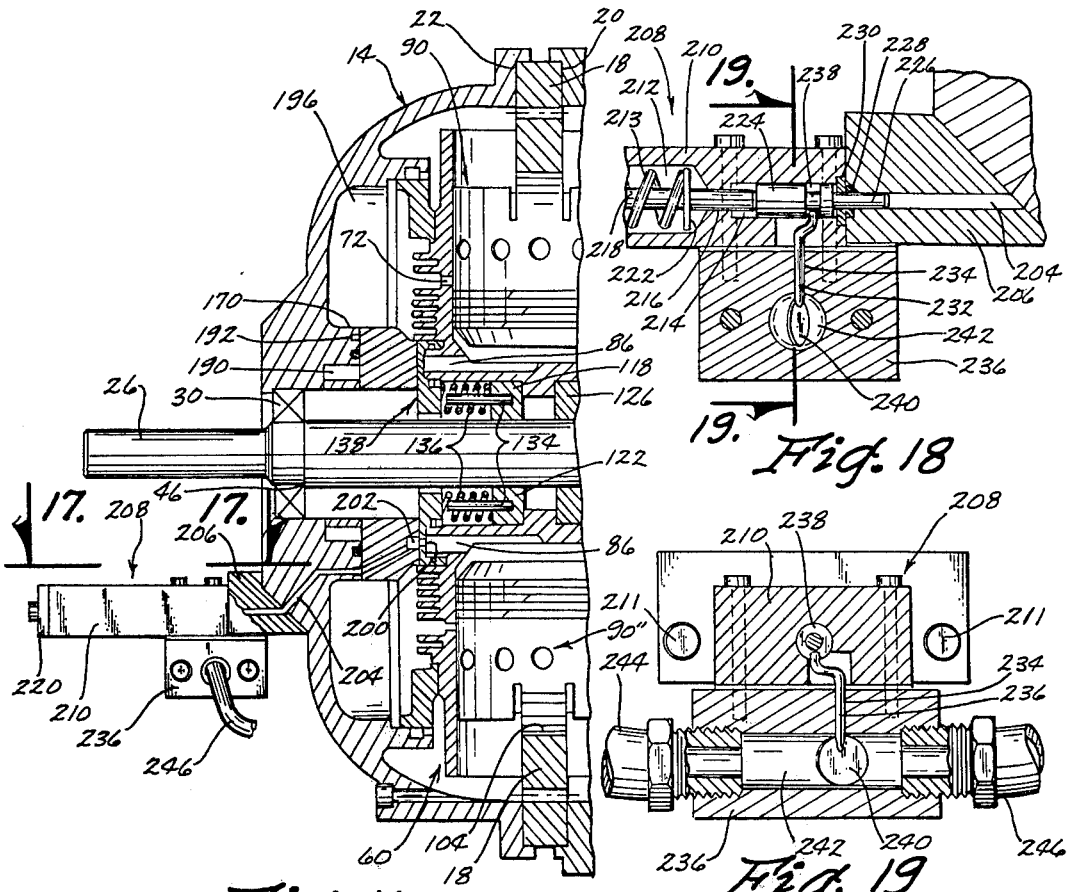
FIG. 16 is a partial sectional view of a modified form of the invention showing the cylinder pressure sensing apparatus.
FIG. 17 is an enlarged scale sectional view of the pressure sensing apparatus taken on line 17—17 of FIG. 16.
FIG. 18 is a partial sectional view of the pressure sensing apparatus taken on line 18—18 of FIG. 17.
FIG. 19 is a partial sectional view of the pressure sensing apparatus taken on line 19—19 of FIG. 18.
FIG. 20 is a partial sectional view similar to that of FIG. 18 but shows a temperature monitoring apparatus for the cylinder.

The engine 10A in FIG. 16 has the same structural components as the previously described engine 10, except as indicated hereafter. The modified engine 10A is particularly adapted to have its ignition timing carefully controlled.

The ignition timing of a conventional diesel engine is controlled by introducing fuel at a predetermined time. This prevents the fuel from completely volatizing before combustion. As a result, combustion is incomplete, and engine inefficiencies result. The engine 10A in FIGS. 16 – 19 controls the timing of the engine by monitoring and controlling the pressure in the cylinders so combustion takes place at exactly the time and place desired. The modified form of the invention in FIG. 20 accomplishes the same result by monitoring and controlling temperature in the cylinders. The seal plate 138 is provided with an aperture 200 which interconnects intake port 86 and slot 202 in valve plate 164. The preferred position of slot 202 in plate 164 is shown by dotted lines in FIG. 6. Bore 204 extends through plate 164, frame 14, and through frame member 206. Control element 208 is secured to frame member 206 by conventional screws 211 (FIG. 17). As will be seen hereafter, control element 208 will monitor and control the ignition pressure in the cylinders, and thereby precisely control the ignition timing of the engine.

Control element 208 is comprised of a housing 210 having a longitudinal bore 212 interconnected to a smaller bore 214 by aperture 216. Bore 214 is in communication with the previously described bore 204. A shaft 218 extends through bore 212 and has its inner end slidably supported in aperture 216 and its outer end slidably supported in a suitable aperture in end plate 220. A retaining washer 222 is fixed to the shaft 218 adjacent the inner end of bore 212, and a compression spring 213 is mounted on the shaft with its opposite ends engaging the washer 222 and end plate 220. Spring 213 is slightly compressed.

A plunger 224 is slidably mounted in bore 214 and shaft 226 protrudes from one end thereof to slidably penetrate bore 204. O-ring 228 and retaining washer 230 embrace shaft 226 as shown in FIGS. 17 and 18. A crankshaft 232 is pivotally mounted in bore 234 of valve block 236. The upper end of crankshaft 232 is received in annular groove 238 of plunger 224 whereby longitudinal movement of the plunger will cause the crankshaft to rotate. Valve plate 240 dwells in the longitudinal bore 242 of valve block 236 and is secured to the lower end of crankshaft 232, whereby rotation of the crankshaft can open or close the bore 242, depending on the direction of rotation. Conduit 244 is connected to a source of air (not shown) and conduit 246 is adapted to introduce air into the cylinders as previously described through conduit 195. Fuel may be mixed with the air to be introduced into the cylinders if desired without changing the function or purpose control element 208.

The control element 208 functions as follows: The strength of spring 213 and the position of crankshaft 232 (and valve plate) are predetermined so that a proper amount of air is supplied to the cylinders through conduits 246 and 195, wherein under normal conditions of ambient temperature, humidity, and altitude, sufficient pressure will be created in the cylinders to achieve combustion just prior to the end of the compression stroke and just prior to the "dwell" position of the cylinders as previously described. It is preferred that combustion should be commenced at this time (see the position of piston 90'' in FIG. 16), and that it continues during the dwell position. This will insure that proper volatization of the fuel will have taken place if ignition is timed to this point in the cycle. When the engine is functioning properly with ignition taking place a predetermined pressure (e.g. 150 p.s.i.), the components in control element 208, which are in communication with the pressure of cylinder 60 just prior to the dwell position near the end of the compression stroke, are in a substantially static condition as shown in FIG. 18. However, if conditions of ambient temperature, humidity, or altitude cause an increase in the cylinder pressure at the time it is being sampled, to cause an early ignition, this pressure will be reflected on shaft 226 in bore 204, and will cause plunger 224 to move to the left as viewed in FIG. 17 against the spring 213. This will cause a slight movement of crankshaft 232 which will in turn cause valve plate 240 to slightly close bore 242. Thus, with less air being supplied to the cylinders, the pressure will be reduced on compression, and the original ignition pressure will be resumed. If there is a decrease in the cylinder pressure to cause a later ignition, the spring 213 will move against the pressure being exerted on shaft 226 on plunger 224, and this will cause the crankshaft 232 and valve plate 240 to open slightly the bore 242 so that additional air will be delivered to the cylinders. This will increase the cylinder pressure and will advance the point of ignition. The foregoing adjustment of pressure is accomplished without adjusting the pressure of the fuel introduced into the cylinder during the intake portion of the cycle.

It should be understood that all the cylinders could be easily monitored, although only one has been shown to be sampled in FIG. 16. Furthermore, the control element 208 would work equally well on a vacuum engine wherein negative pressure would be monitored. The cylinders could be sampled and monitored at other than the end of the compression stroke, but the latter point in the cycle is preferred.

The structure of FIG. 20 is substantially identical to that of FIG. 18 except that the temperature in the cylinders is being monitored through conduit 204. The structure of FIG. 20 could obviously be adapted to that of FIG. 18 so that both pressure and temperature could be monitored. A thermo-coil 248 of conventional construction in control element 208A is adjustably mounted on screw 250 and is coupled in conventional fashion to crankshaft 232. The coil 248 is set to sample temperature just at the end of the compression cycle. As long as this temperature exists, the coil will remain static, and the air supply through core 242 will remain constant. If the temperature in the cylinders increases or decreases, the coil will expand or retract, respectively, to cause crankshaft 232 to rotate which will result in less or more air to be supplied to the cylinders to rectify the adverse temperature conditions, and hence, the adverse ignition timing.

It is preferred that the conditions within the cylinder be monitored at a point or at a time during the initial stages of ignition in the compression cycle under the desired ignition timing. However, some variations can be permitted within this invention, but the monitoring should take place when the conditions of temperature and pressure within the cylinder are at less than maximum, and at a time when the engine is operating between its maximum power capability but greater than its idling power setting. In some applications, the cylinders can best be monitored substantially at the end of the compression cycle when the piston is at or near a top center position. For best reliability, monitoring should always take place when the temperature and pressure are less than maximum, i.e., not towards the end of ignition when maximum work is developed in the expansion cycle.

Thus, the foregoing control elements monitor pressure and temperature of the cylinders at approximately the initial stages of ignition or near the end of the compression cycle, and automatically make adjustments for changes in pressure and temperature within the cylinders whenever other than predetermined conditions are encountered. As a result, timing of ignition can be precisely controlled.

Thus it can be seen that the rotary internal combustion engine of this invention accomplishes at least all of its stated objectives.

I claim:

1. The method of controlling the timing of ignition in an internal combustion compression engine comprising cylinders, reciprocating pistons, a supply of fuel and air to such cylinders, and wherein said engine has a predetermined maximum operating power capability and a predetermined idling power setting, comprising, introducing combustible fuel into said cylinders, compressing said fuel to combust the same, determining the conditions of temperature and pressure within at least one of said cylinders at a time period in the engine cycle when the engine is operating at the predetermined ignition timing conditions which are sought to be maintained; said time period being during the time when conditions of temperature and pressure within the cylinder are at less than maximum, and when said engine is operating at between the maximum power capability but at greater than its idling power setting, intermittently monitoring the conditions of temperature and pressure within said cylinder at the same time period in the engine cycle as said foregoing time period during operation of said engine, introducing air under pressure into said cylinder during an intake portion of the cycle of said piston within said cylinder, and restoring the predetermined conditions of temperature and pressure to said cylinder when variations in temperature and pressure are detected during said monitoring by adjusting the pressure of air introduced into said cylinder during said intake portion of the cycle of said piston.

2. The method of claim 1 wherein said conditions of temperature and pressure are restored by adjusting the amount of air supplied to said cylinder.

3. The method of claim 1 wherein the the monitoring takes place in the cylinder at a time during the initial stages of ignition of fuel in said cylinder.

4. The method of claim 1 wherein said monitoring takes place in the cylinder substantially at the end of the compression stroke of said piston in said cylinder.

5. The method of controlling the timing of ignition in an internal combustion compression engine comprising cylinders, reciprocating pistons, a supply of fuel and air to such cylinders, and wherein said engine has a predetermined maximum operating power capability and a predetermined idling power setting, comprising, introducing combustible fuel into said cylinders, compressing said fuel to combust the same, determining the conditions of temperature and pressure with at least one of said cylinders at a time period in the engine cycle when the engine is operating at the predetermined ignition timing conditions which are sought to be maintained; said time period being during the time when conditions of temperature and pressure within the cylinder are at less than maximum, and when said engine is operating at between its maximum power capability but at greater than its idling power setting, intermittently monitoring the conditions of temperature and pressure within said cylinder at the same time period in the engine cycle as said foregoing time period during operation of said engine, introducing air under pressure into said cylinder during an intake portion of the cycle of said piston within said cylinder, and restoring the predetermined conditions of temperature and pressure to said cylinder when variations in temperature and pressure are detected during said monitoring by adjusting the pressure of air introduced into said cylinder during said intake portion of the cycle of said piston without adjusting the pressure of fuel introduced into said cylinder during said intake portion of the cycle of said piston.

6. The method of claim 5 wherein said conditions of temperature are restored by adjusting the amount of air supplied to said cylinder.

7. The method of claim 6 wherein the monitoring takes place in the cylinder at a time during the initial stages of ignition of fuel in said cylinder.

8. The method of claim 6 wherein said monitoring takes place in the cylinder substantially at the end of the compression stroke of said piston in said cylinder.

9. The method of controlling the timing of ignition in an internal combustion compression engine comprising cylinders, reciprocating pistons, a supply of fuel and air to such cylinders, and wherein said engine has a predetermined maximum operating power capability and a predetermined idling power setting, comprising, introducing combustible fuel into said cylinders, compressing said fuel to combust the same, determining the conditions of pressure within at least one of said cylinders at a time period in the engine cycle when the engine is operating at the predetermined ignition timing conditions which are sought to be maintained; said time period being during the time when conditions of pressure within the cylinder are at less than maximum, and when said engine is operating at between its maximum power capability but at greater than its idling power setting, intermittently monitoring the conditions of pressure within said cylinder at the same time period in the engine cycle as said foregoing time period during operation of said engine, introducing air under pressure into said cylinder during an intake portion of the cycle of said piston within said cylinder, and restoring the predetermined conditions of pressure to said cylinder when variations in pressure are detected during said monitoring by adjusting the pressure of air introduced into said cylinder during said intake portion of the cycle of said piston without adjusting the pressure of fuel introduced into said cylinder during said intake portion of the cycle of said piston.

10. The method of claim 10 wherein said conditions of pressure are restored by adjusting the amount of air supplied to said cylinder.

11. The method of claim 11 wherein the monitoring takes place in the cylinder at a time during the initial stages of ignition of fuel in said cylinder.

12. The method of claim 11 wherein said monitoring takes place in the cylinder substantially at the end of the compression stroke of said piston in said cylinder.

13. The method of controlling the timing of ignition in an internal combustion engine comprising cylinders, reciprocating pistons, a supply of fuel and air to such cylinders, and wherein said engine has a predetermined maximum operating power capability and a predetermined idling power setting, comprising, determining the conditions of temperature and pressure within at least one of said cylinders at a time period in the engine cycle when the engine is operating at the predetermined ignition timing conditions which are sought to be maintained;

intermittently monitoring the conditions of temperature and pressure within said cylinder at the same time period in the engine cycle as said foregoing time period during operation of said engine, introducing air under pressure into said cylinder during an intake portion of the cycle of said piston within said cylinder, and restoring the predetermined conditions of temperature and pressure to said cylinder when variations in temperature and pressure are detected during said monitoring by adjusting the pressure of air introduced into said cylinder during said intake portion of the cycle of said piston without adjusting the pressure of fuel introduced into said cylinder during said intake portion of the cycle of the said piston.

14. The method of controlling the timing of ignition in an internal combustion compression engine comprising cylinders, reciprocating pistons, a supply of fuel and air to such cylinders, and wherein said engine has a predetermined maximum operating power capability and a predetermined idling power setting, comprising introducing combustible fuel into said cylinders, compressing said fuel to combust the same, determining the conditions of temperature within at least one of said cylinders at a time period in the engine cycle when the engine is operating at the predetermined ignition timing conditions which are sought to be maintained, intermittently monitoring the conditions of temperature within said cylinder at the same time period in the engine cycle as said foregoing time period during operation of said engine, introducing air under pressure into said cylinder during an intake portion of the cycle of said piston within said cylinder, and restoring the predetemined conditions of temperature to said cylinder when variations in temperature are detected during said monitoring by adjusting the pressure of air introduced into said cylinder during said intake portion of the cycle of said piston without adjusting the pressure of fuel introduced into said cylinder during said intake portion of the cycle of said piston.

15. The method of controlling the timing of ignition in an internal combustion compression engine comprising cylinders, reciprocating pistons, a supply of fuel and air to such cylinders, and wherein said engine has a predetermined maximum operating power capability and a predetermined idling power setting, comprising, introducing combustible fuel and into said cylinders compressing said fuel to combust the same, determining the conditions of pressure within at least one of said cylinders at a time period in the engine cycle when the engine is operating at the predetermined ignition timing conditions which are sought to be maintained, intermittently monitoring the conditions of pressure within said cylinder at the same time period in the engine cycle as said foregoing time period during operation of said engine, introducing air under pressure into said cylinder during an intake portion of the cycle of said piston within said cylinder, and restoring the predetermined conditions of pressure to said cylinder when variations in pressure are detected during said monitoring by adjusting the pressure of air introduced into said cylinder during said intake portion of the cycle of said piston without adjusting the pressure of fuel introduced into said cylinder during said intake portion of the cycle of said piston.

* * * * *